US005333599A

United States Patent [19]

Jang

[11] Patent Number: 5,333,599

[45] Date of Patent: Aug. 2, 1994

[54] EXTERNAL BODY OF SMOKE EXHAUSTER

[76] Inventor: Sun-Sing Jang, 650, Yuan-Huan E. Rd., Fong-Yuan, Taichung Hsien, Taiwan

[21] Appl. No.: 90,948

[22] Filed: Jul. 13, 1993

[51] Int. Cl.[5] ..... F24C 15/20

[52] U.S. Cl. ..... 126/299 D; 126/299 R

[58] Field of Search ..... 126/299 R, 299 D

[56] References Cited

U.S. PATENT DOCUMENTS 2,901,963 9/1959 Richardson ..... 126/299 D

*Primary Examiner*—Carroll B. Dority

*Attorney, Agent, or Firm*—Browdy and Neimark

[57] ABSTRACT

This invention is directed to smoke exhauster having two side members and a top plate. The side member includes a main portion having a plurality of horizontal rods disposed on an internal wall and a top portion. Both left and right edges of the top plate are bent downwardly to form a vertical plate portion having a plurality of through holes corresponding in location and number to the horizontal rods. A plurality of bolts pass through the through holes and are threaded to the horizontal rods.

10 Claims, 4 Drawing Sheets

EXTERNAL BODY OF SMOKE EXHAUSTER

BACKGROUND OF THE INVENTION

The present invention relates to a kitchen smoke exhauster, and more particularly to the external body of a smoke exhauster.

As shown in FIGS. 1 & 2, the external body 10 of a smoke exhauster of the prior art comprises top plate 11, left plate 12, right plate 13 and rear plate 14. Both left and right plate 12, 13 are respectively provided with the projected strips 121, 131 disposed on the rims thereof. In the process of combining various plates to form the external body 10, both the left and right plates 12, 13 are united with the top plate 11 by fitting the projected strips 121, 131 over the left and the right edges of the top plate 11. The top plate 11, the left plate 12 and the right plate 13 are further fastened securely by means of spot welding.

The external body 10 of the prior art smoke exhauster described above possesses the disadvantage that the projecting flanges 121 and 131 fitting over the edges of the top plate 11 have sharp edges 123, which often become potential safety hazards, especially to a person who is cleaning and washing the external body 10. The projecting flanges 121 and 131 of the left and right plates 12 and 13 are often left with sharp edges, in view of the fact that they are made of thin sheet stainless steel by means of punching and pressing. In addition, the spot weld points 122 and 132 leave many visible marks on the external body 10, as shown in FIGS. 1 &2. Such weld points 122 and 132 seriously undermine the aesthetic effect of the external body 10.

SUMMARY OF THE INVENTION

It is therefore an object of the present invention to provide a smoke exhauster with an external body devoid of sharp edges which may inflict an injury to a user or a worker.

The present invention may best be understood through the following description with reference to the accompanying drawings, in which:

DETAILED DESCRIPTION OF THE PREFERRED EMBODIMENTS

Figure 1:
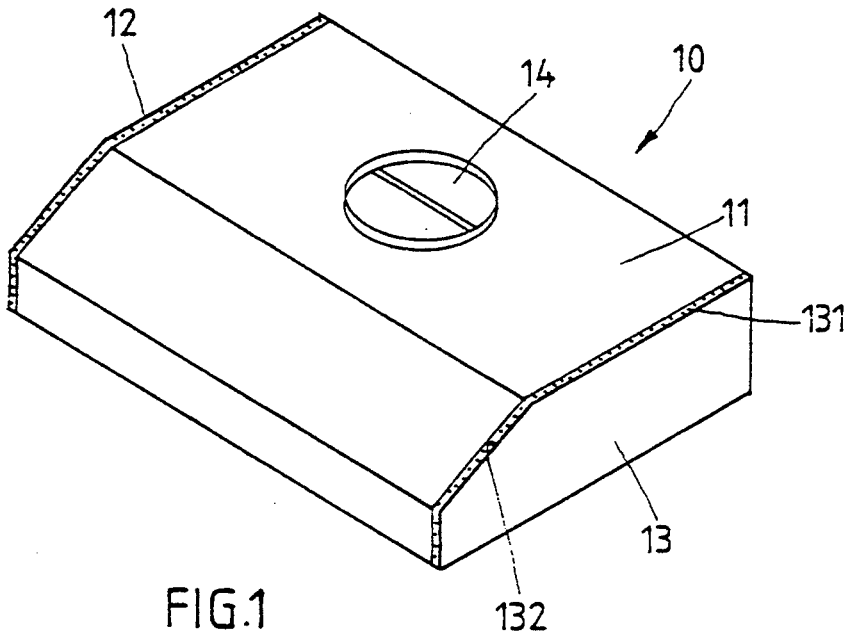
FIG.1 PRIOR ART
FIG. 1 is a perspective assembly view of the external body of a conventional smoke exhauster.
Figure 2:
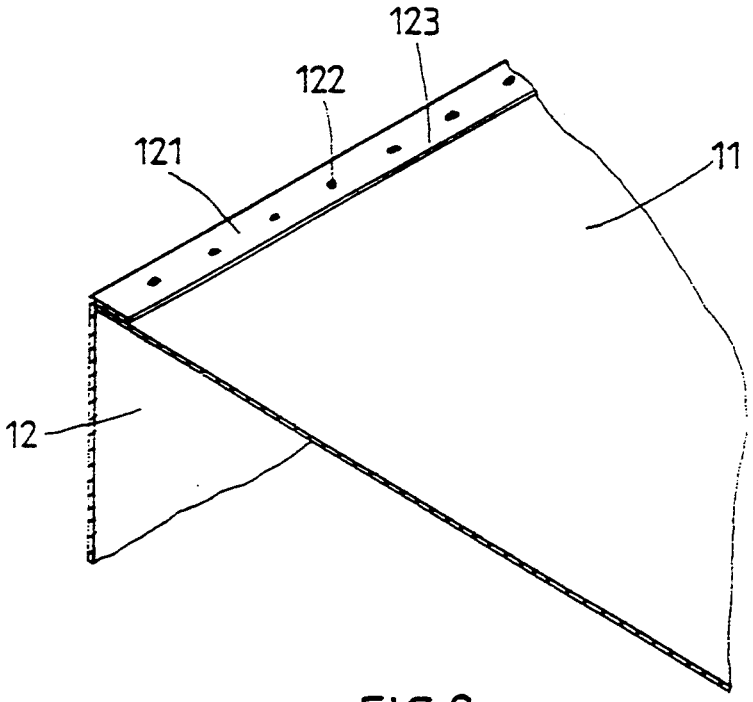
FIG.2 PRIOR ART
FIG. 2 is an enlarged partial perspective view of FIG. 1.
Figure 3:
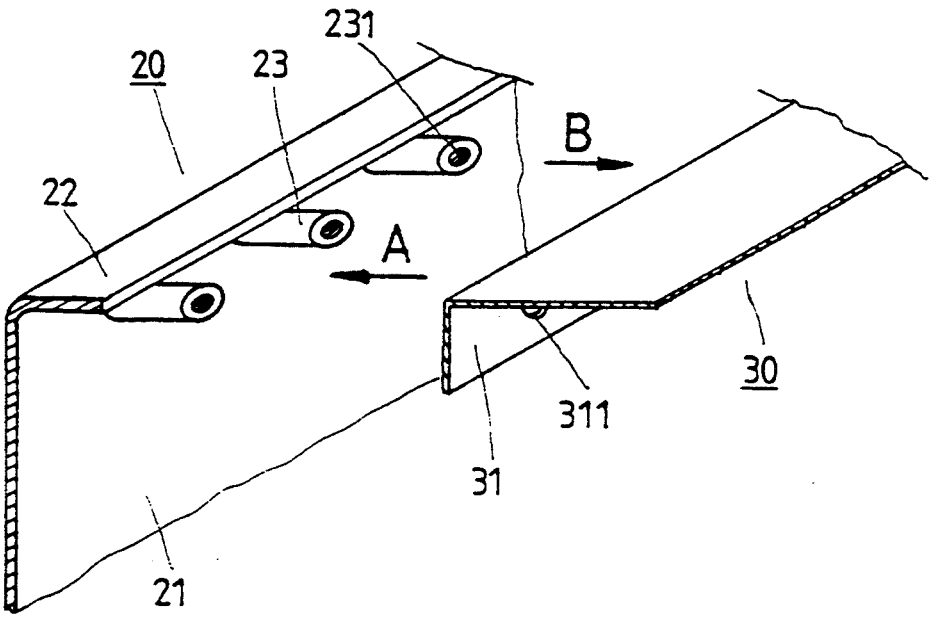
FIG. 3 is a schematic view showing features of separated structures of the first preferred embodiment of the present invention.
Figure 4:
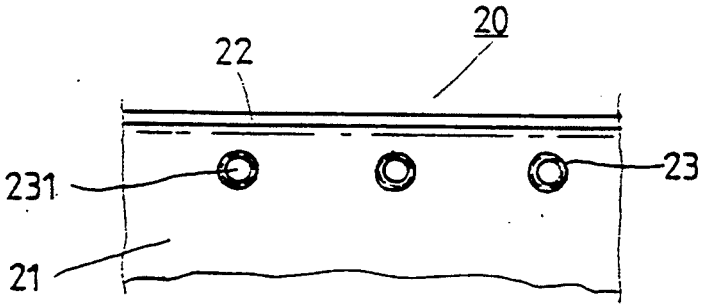
FIG. 4 is a plan view viewing from the A direction in FIG. 3.
Figure 5:
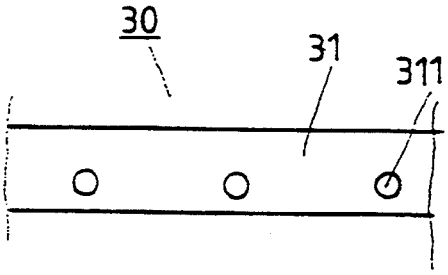
FIG. 5 is a plan view viewing from the B direction in FIG. 3.
Figure 6:
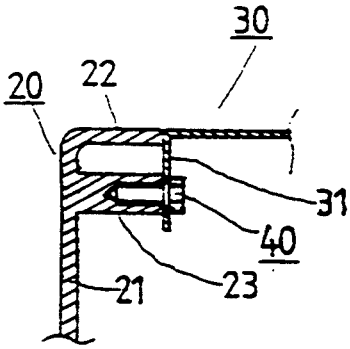
FIG. 6 is a schematic view of the combination of structures of the first preferred embodiment according to the present invention.
Figure 7:
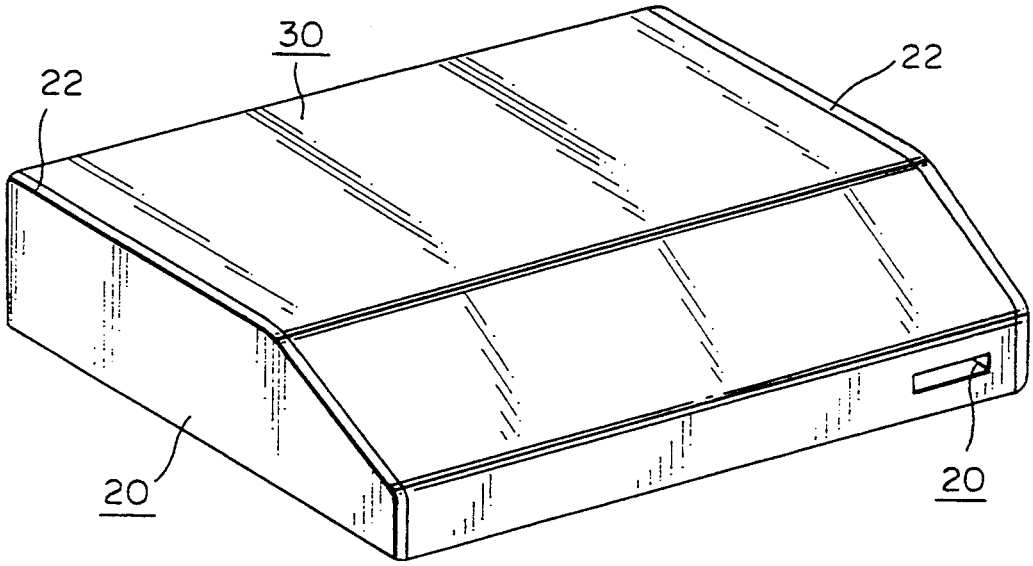
FIG. 7 is an external perspective view showing an external body of a smoke exhauster according to the present invention.

Referring to FIGS. 3–7, ,a first preferred embodiment of an external body of a smoke exhauster according to the present invention includes two side members 20 and a top plate 30.

The side member 20, which is made of a refractory plastic or plastic-steel material by injection molding, has a main portion 21 and a top portion 22 extending inwardly and horizontally from the top edge of the main portion 21. The main portion 21 is provided on the top section of the internal wall thereof with a plurality of horizontal rods 23. The axis of outer horizontal rod 23 is parallel to the surface of the top portion 22. The horizontal rods 23 respectively have an axial threaded hole 231.

The top plate 30 is provided at each side with a vertical plate portion 31 formed by bending the left and right sides of the top plate 30 downwardly. The vertical plate portion 31 is provided with a plurality of through holes 311 corresponding in location and number to the horizontal rods 23. In combination, the vertical plate portion 31 of the top plate 30 is placed close to the horizontal rods 23 of the side member 20, so that the through holes 311 correspond to the horizontal rods 23. Then, a plurality of bolts 40 are passed through the through holes 311 and threaded in holes 231 of the horizontal rods 23.

The external body of a kitchen smoke exhauster embodying the present invention has the following advantage over the prior art, that is, the edges of the top sheet and side sheets are united in such a unique manner that there are effectively no exposed edges which may cause accidental injury to an assembly worker or a person cleaning the body.

Figure 8:
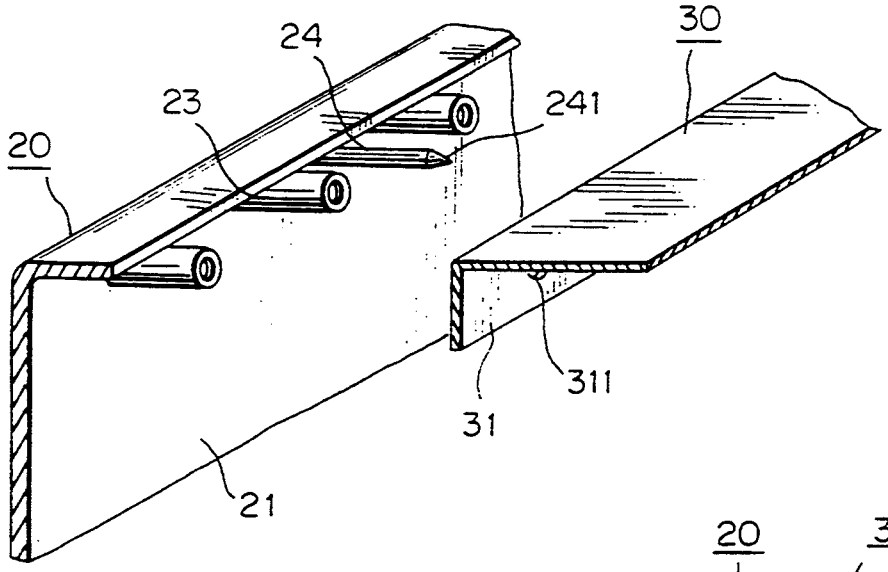
FIG. 8 is a schematic view showing features of separated structures of the second preferred embodiment of the present invention.
Figure 9:
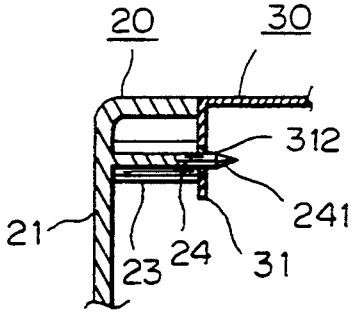
FIG. 9 is a schematic view of combination of structures of the second preferred embodiment according to the present invention.

Now referring to FIGS. 8 & 9, a second preferred embodiment of the present invention differs from the first preferred embodiment of the present invention in that an a top section of the internal wall of the main portion 21 is further formed with two or three horizontal positioning rods 24 between the horizontal rods 23. The length of the positioning rod 24 is longer than the horizontal rod 23. The vertical plate portion 31 further has two or three holes 312 corresponding in location to the positioning rods 24. In the process of assembling the external body of the second preferred embodiment, the outer section of the positioning rods 24 respectively pass through the holes 312, and through holes 3! 1 are simultaneously positioned to correspond to the horizontal rods 23. Thereafter, bolts 40 can be threaded into horizontal rods 23 in an easier manner. The outer end 241 of the positioning rod 24 can be formed to taper in shape so that they may pass through the hole 312 easily.

Figure 10:
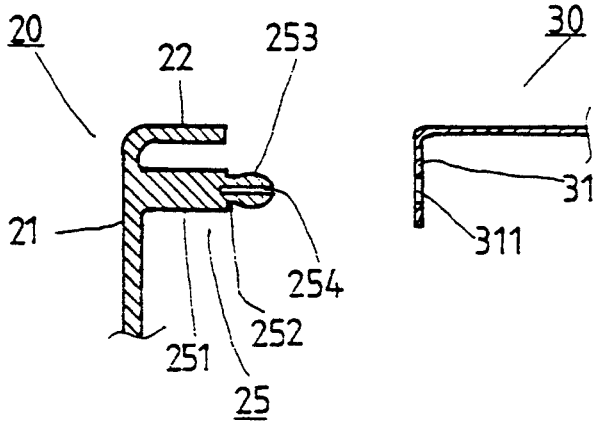
FIG. 10 is a schematic view showing features of separated structures of the third preferred embodiment according to the present invention.
Figure 11:
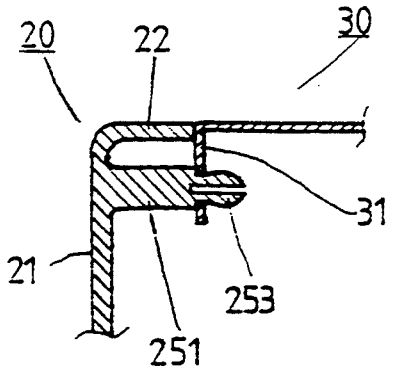
FIG. 11 is a schematic view of combination of structures of the fourth preferred embodiment according to the present invention.

A third preferred embodiment of the present invention, as shown in FIGS. 10 & 11, has different horizontal rods from that of the first embodiment. The horizontal rod 25 includes a first portion 251, a second portion 252 and a head portion 253 having thereon at least one axial gap 254. The axis of the first portion 251 is parallel to the surface of the top portion 22. The diameter of the second portion 252 is smaller than the internal diameter of the through hole 311 of the top plate 30, and the axial length of the second portion 252 is longer than the width of the through hole 311. The head portion 253 has a tapered shape. In the process of assembling the external body of the third embodiment, the head portion 253 can be easily passed through the through hole 311 due to axial gap 254. Thereafter, the second portion 252 is disposed in the through hole 311 and in the position, as shown in FIG. 11.

Figure 12:
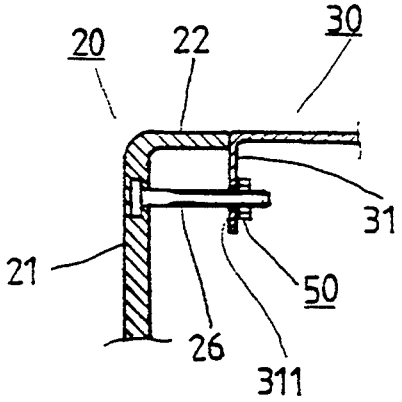
FIG. 12 is a schematic view of combination of structures of the fourth preferred embodiment according to the present invention.

FIG. 12 shows a fourth preferred embodiment of the present invention differing from the first embodiment in that the top section of the internal wall of the main portion 21 is formed a plurality of horizontal threaded rods 26. The length of the screwed rod 26 is longer than the width of the top portion 22, so that the outer section of the threaded rod 26 passes through hole 311 of the top plate 30, and a nut 50 threaded thereon against the internal wall of the vertical plate portion 31.

while the invention has been described in connection with what is presently considered to be the most practical and preferred embodiments, it is to be understood that the invention is not to be limited to the disclosed embodiments but on the contrary, is intended to cover various modifications and equivalent arrangements included within the spirit and scope of the appended claims which scope is to be accorded the broadest interpretation so as to encompass all such modifications and equivalent structures.

What is claimed is:

1. An external body of a smoke exhauster comprising:

a top plate having left and right sides individually bent downwardly to form a vertical plate portion each having a plurality of through holes respectively;

two side members respectively engaged to said left and right sides of said top plate, each of said two side members including a main portion having a plurality of abutment rods disposed on a top section of an internal wall of said main portion corresponding in location and number to said through holes, each of aid two side members having a top portion extending inwardly in a plane of said top plate from a top edge of said main portion, axes of said abutment rods being parallel to a plane of said top portion, each of said abutment rods respectively further having an axial threaded hole respectively corresponding in location to each of said through holes; and a plurality of bolts passing through said through holes and threaded in said threaded holes of said abutment rods to engage each said top portion against said top plate and ends of said abutment rods against said left and right sides of said top plate.

2. An external body of a smoke exhauster according to claim 1 wherein said two side members are made of a refractory plastic or plastic-steel material by injection molding.

3. An external body of a smoke exhauster according to claim 1 wherein:

said left and right sides of said top plate further having additional holes between said through holes; and said top section of said internal wall of said main portion further having positioning rods corresponding in location to said additional holes, said positioning rods being longer than said abutment rods and passing through said additional holes to align said through holes to correspond to said abutment rods.

4. An external body of a smoke exhauster according to claim 3 wherein said two side members are made of a refractory plastic or plastic-steel material by injection molding.

5. An external body of a smoke exhauster according to claim 3 wherein a free end of said positioning rod is tapered.

6. An external body of a smoke exhauster according to claim 5 wherein said two side members are made of a refractory plastic or plastic-steel material by injection molding.

7. An external body of a smoke exhauster comprising:

a top plate having left and right sides individually bent down to form vertical plate portions each having a plurality of through holes respectively;

two side members respectively engaged to said left and right sides of said top plate, each of said two side members including a main portion having a plurality of abutment rods disposed on a top section of an internal wall of said main portion corresponding in location and number to said through holes, a top portion extending inwardly in a plane of said top plate from a top edge of said main portion, each of said abutment rods further having a first portion, a second portion and a head portion having a tapered shape, said head portion having at least one axial gap to facilitate said head portion passing through said through hole, an axis of said first portion being parallel to a plane of said top portion, a diameter of said second portion being smaller than an internal diameter of each of said through holes, and an axial length of said second portion being longer than a width of said through hole to permit location of said second portion in said through hole.

8. An external body of a smoke exhauster according to claim 7 wherein said two side members are made of a refractory plastic or plastic-steel material by injection molding.

9. An external body of a smoke exhauster comprising:

a top plate includes left and right sides individually bent down to form a vertical plate portion each having a plurality of through holes respectively;

two side members respectively engaged to said left and right sides of said top plate, each of said two side members including a main portion having a plurality of threaded abutment rods disposed on a top section of an internal wall of said main portion corresponding in location and number to said through holes, each of said two side members having a top portion extending inwardly in a plane of said top plate from a top edge of said main portion, each of said threaded abutment rods being longer than a width of said top portion so that an outer section of each of said threaded abutment rods pass through a through hole of said through holes of said top plate; and a plurality of nuts respectively threaded on each said outer section of said threaded abutment rods to engage against an internal wall of said vertical plate portion.

10. An external body of a smoke exhauster according to claim 9 wherein said two side members are made of a refractory plastic or plastic-steel material by injection molding.

* * * * *